US011117342B2

(12) United States Patent
Schuman et al.

(10) Patent No.: US 11,117,342 B2
(45) Date of Patent: Sep. 14, 2021

(54) EMBOSSING TOOL FOR DEFORMING SMOOTH AND EMBOSSED FILMS

(71) Applicant: BERHALTER AG, Widnau (CH)

(72) Inventors: Dalibor Schuman, Widnau (CH); Markus Steiner, Rebstein (CH)

(73) Assignee: Berhalter AG, Widnau (CH)

( * ) Notice: Subject to any disclaimer, the term of this patent is extended or adjusted under 35 U.S.C. 154(b) by 270 days.

(21) Appl. No.: 16/331,695

(22) PCT Filed: Aug. 29, 2017

(86) PCT No.: PCT/EP2017/071594
§ 371 (c)(1),
(2) Date: Mar. 8, 2019

(87) PCT Pub. No.: WO2018/046340
PCT Pub. Date: Mar. 15, 2018

(65) Prior Publication Data

US 2019/0240944 A1 Aug. 8, 2019

(30) Foreign Application Priority Data

Sep. 8, 2016 (CH) ..... 1163/16

(51) Int. Cl.
*B31B 50/88* (2017.01)
*B31B 50/14* (2017.01)
*B31F 1/07* (2006.01)

(52) U.S. Cl.
CPC ..... *B31B 50/88* (2017.08); *B31B 50/142* (2017.08); *B31F 1/07* (2013.01); *B31F 2201/0702* (2013.01)

(58) Field of Classification Search
CPC ..... B31B 50/88; B31B 50/142; B31F 1/07; B31F 2201/0702
See application file for complete search history.

(56) References Cited

U.S. PATENT DOCUMENTS 1,161,881 A * 11/1915 Petrelius ..... B05D 3/12 427/277
1,752,298 A * 4/1930 Greffin ..... B31F 1/07 101/395
2,005,340 A * 6/1935 Jaffin ..... B44B 5/0085 101/28
2,021,105 A * 11/1935 Kreider, Jr. ..... B31B 50/00 493/111
2,029,567 A * 2/1936 Hough ..... B21D 37/20 76/107.1
2,722,038 A * 11/1955 Freund ..... B29C 51/085 264/132
4,542,691 A * 9/1985 Kokrhanek ..... B44C 1/1729 101/114
5,181,464 A * 1/1993 Kuhlman ..... B31F 1/07 101/28

(Continued)

*Primary Examiner* — Nathaniel C Chukwurah
*Assistant Examiner* — Lucas E. A. Palmer
(74) *Attorney, Agent, or Firm* — Volpe Koenig

(57) ABSTRACT

An embossing tool including a female die (5) and a male die (7). A raised section (9) is formed on the female die, which corresponds to the area to be embossed. An elastic compensating element (13) is located in a recess (11) of the male die (7), which protrudes from the surface of the male die (7) by a few tenths of a millimeter. This embossing tool allows the undoing of existing embossments on a film (1).

6 Claims, 5 Drawing Sheets

(56) References Cited

U.S. PATENT DOCUMENTS

| | | | | |
|---|---|---|---|---|
| 5,540,153 | A * | 7/1996 | Campbell | B44B 5/0009 101/216 |
| 6,007,754 | A * | 12/1999 | Crawford | B29C 33/3842 156/256 |
| 6,186,936 | B1 | 2/2001 | Smith et al. | |
| 6,349,639 | B1 * | 2/2002 | Smith | B31F 1/07 101/28 |
| 7,055,427 | B2 * | 6/2006 | Caron | B44B 5/026 101/26 |
| 8,033,215 | B1 * | 10/2011 | Wright | B31F 1/07 101/32 |
| 8,402,889 | B2 * | 3/2013 | Caron | B44C 5/00 101/26 |
| 2001/0000860 | A1 * | 5/2001 | Smith | B31F 1/07 101/32 |
| 2004/0118304 | A1 * | 6/2004 | Corcoran | B31F 1/07 101/28 |
| 2005/0126407 | A1 * | 6/2005 | Hixon | B44B 5/0038 101/31.1 |
| 2005/0211113 | A1 * | 9/2005 | Caron | B30B 15/061 101/32 |
| 2005/0215405 | A1 * | 9/2005 | Corcoran | B31F 1/07 493/143 |
| 2012/0082830 | A1 * | 4/2012 | Fawcett | B31F 1/07 428/211.1 |
| 2012/0091630 | A1 * | 4/2012 | Teague | B31F 1/07 264/400 |
| 2013/0059308 | A1 * | 3/2013 | Makarova | B41F 33/0081 435/6.11 |

* cited by examiner

EMBOSSING TOOL FOR DEFORMING SMOOTH AND EMBOSSED FILMS

BACKGROUND

The subject matter of the invention is an embossing tool for deforming smooth and embossed films.

Films made from metal or laminates of metal and plastic or paper, usually from aluminum, are used in the packaging industry for closing containers of semi-perishable food, such as yogurt cups, but also coffee capsules or coffee packets for commercial operations and for other applications. Cut-outs shaped corresponding to the opening to be closed on the container are punched out from such films and stacked for further processing, that is, the covering process. Punched blanks made from smooth films cause problems during further processing, especially during covering processes, because they can adhere to each other and consequently cannot be separated individually or only incorrectly. This leads to waste on the bottling and covering machines. Consequently, it has been usual for some time to provide embossments on the original materials for punched blanks used as covers. This embossment is typically applied with an embossing roller. The punched blanks provided with a rough or non-smooth surface tend to adhere together significantly less when they are placed together in stacks of thousands of pieces.

This deformation of the films, however, prevents the ability to apply product-specific markings in precisely planned areas. For example, barcodes must be applied, in order to be able to identify the individual containers after their production. For example, a coffee/tea preparation machine must be able to detect whether tea or coffee is in the inserted packaging closed by the film and what sort of product it is, in order to be able to perform the appropriate brewing process. In addition, by use of a barcode or an equivalent marking, the machine can detect from what company the container to be processed originates and whether this container can be processed on the machine or not. The barcode can store countless other information about the product.

If such a barcode is now applied to a rough film provided with embossments, it will be difficult for the reader in the processing machine to read the barcode, because the barcode has not been applied to a flat surface.

Devices are already known with which the areas in which barcodes must be applied are made smooth at a later time. Such a device uses a stamp with which the embossments made in a previous embossing process are made smooth and the printing area can be made flat. This procedure requires, in order to achieve somewhat acceptable results, i.e., smooth areas, high forces that excessively strain the embossing and punching/stamping device. Despite very high forces, a satisfactory result, that is, an absolutely smooth surface of the previously embossed, rough area, cannot be achieved.

SUMMARY

One object of the present invention is now to create a device for deforming smooth and embossed films, with which embossments on films can be undone and a smooth surface of the film can be produced in a specified area.

Another object of the invention is also to apply embossments, that is, deformations, on smooth films with a lower embossing force than in conventional embossing.

This object is achieved by an embossing tool having one or more of the features of the invention. Advantageous constructions of the embossing tool are described below and in the claims.

Through an elastic support of the female die and/or the male die on the back side of the embossing area (raised sections or recessed sections), it is achieved that the embossed area can be undone with lower pressing force not only partially, but completely, and a smooth surface can be achieved on the film. Consequently, it is not only possible to smooth an embossed area again, but this procedure can also be achieved with a significantly lower force.

Not only is the removal or undoing of embossments achieved by the placement of the female die and/or the male die, but also the embossment of smooth film areas can be achieved with significantly lower force and thus less stress on the press/device.

BRIEF DESCRIPTION OF THE DRAWINGS

The invention will be described in more detail with reference to two embodiments: Shown are.

DETAILED DESCRIPTION

Figure 1:
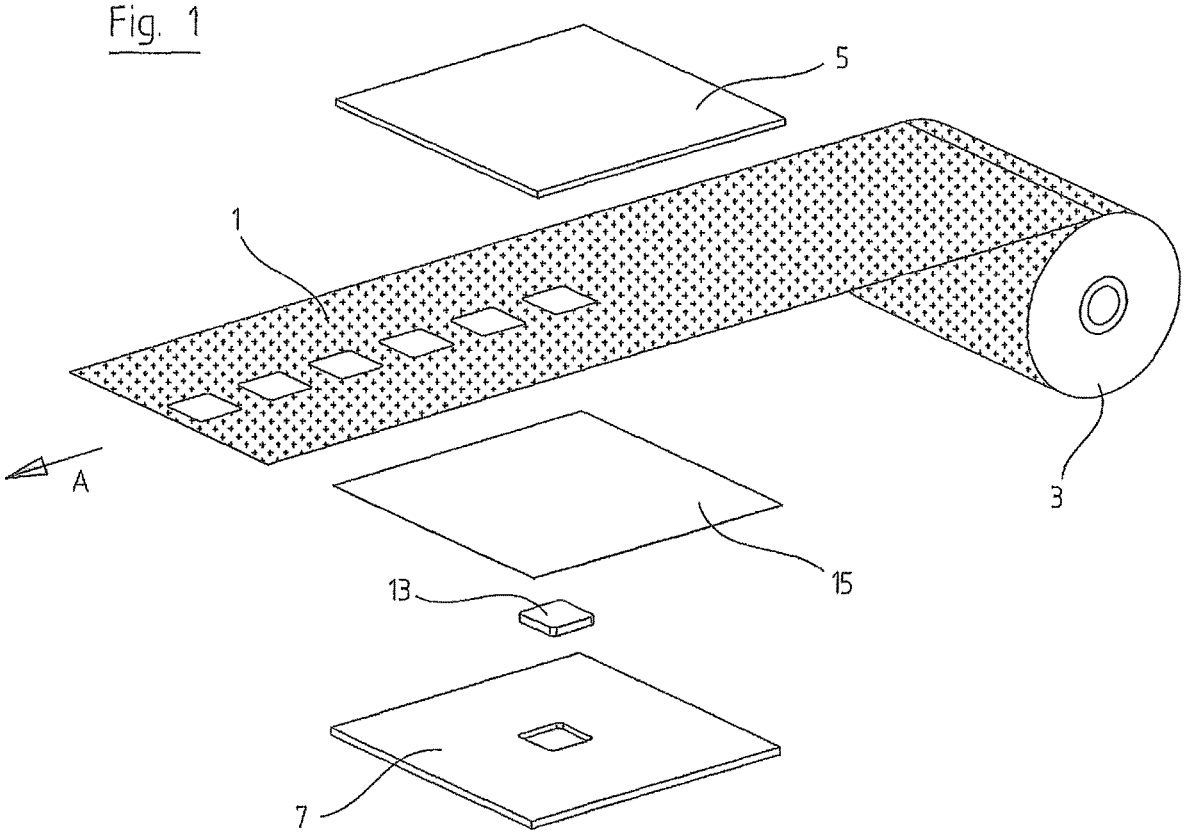
FIG. 1 a schematic exploded-view diagram of a device for removing embossments, FIG. 2 a cross section of FIG. 1 through a device for removing or undoing an embossment on an embossed film, FIG. 3 a view of a female die or die plate, FIG. 4 a view of a male die or retaining plate with compensating element, FIG. 5 a view of a compensating element for insertion into the male die, FIG. 6 a schematic exploded-view diagram of a device for embossing a smooth film (view from above), FIG. 7 a schematic exploded-view diagram of a device for embossing a smooth film (view from below), and FIG. 8 a cross section in FIG. 6 through a device for embossing a film according to FIGS. 6 and 7.
Figure 2:
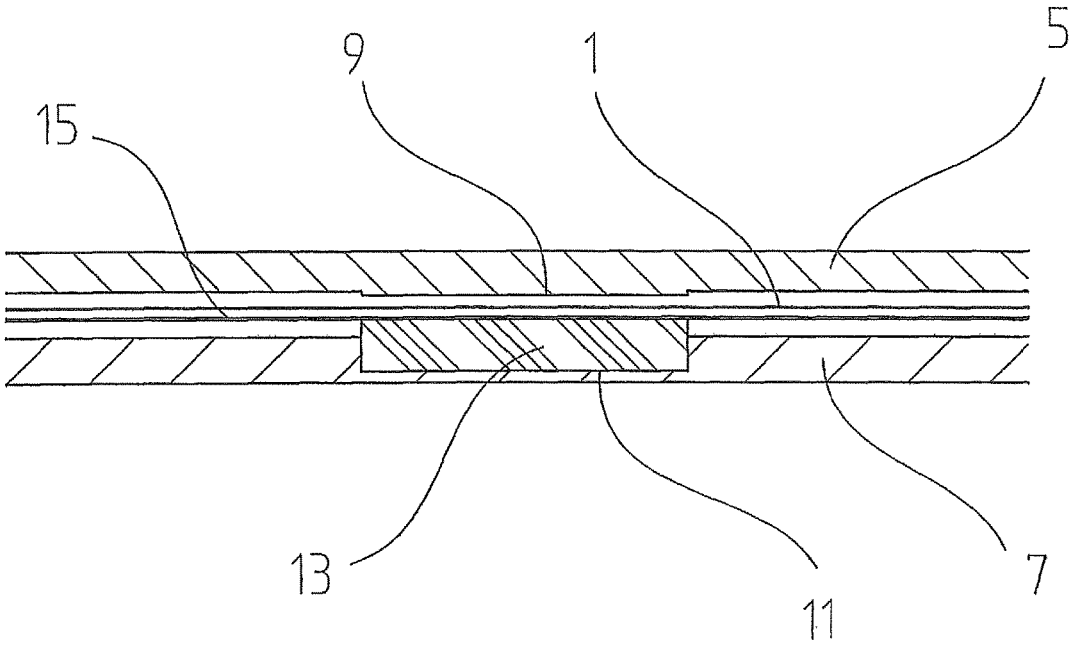
Figure 3:
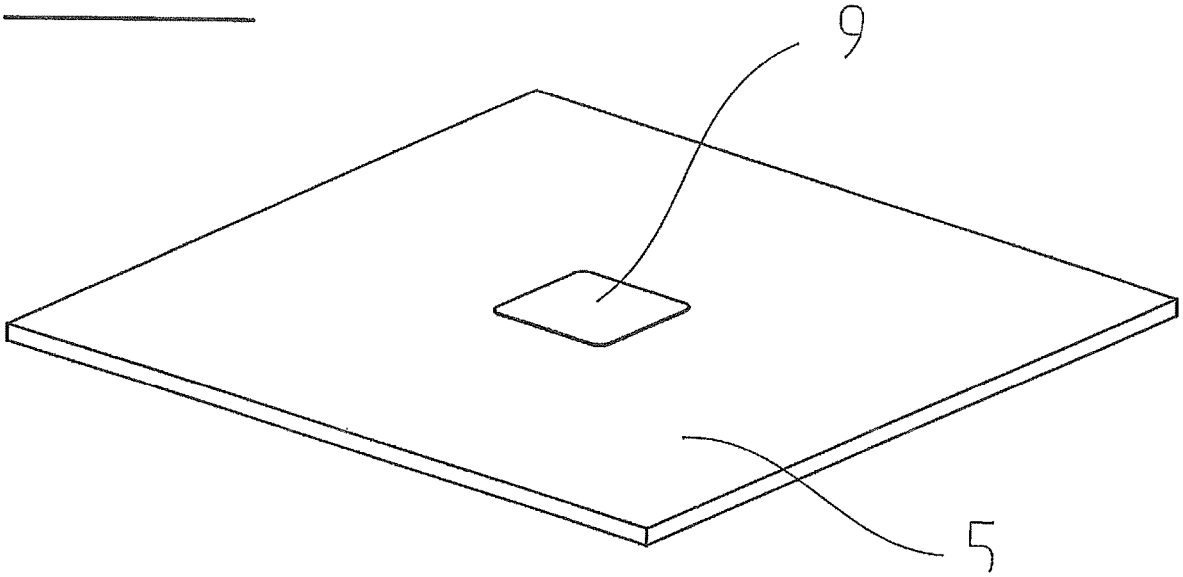
Figure 4:
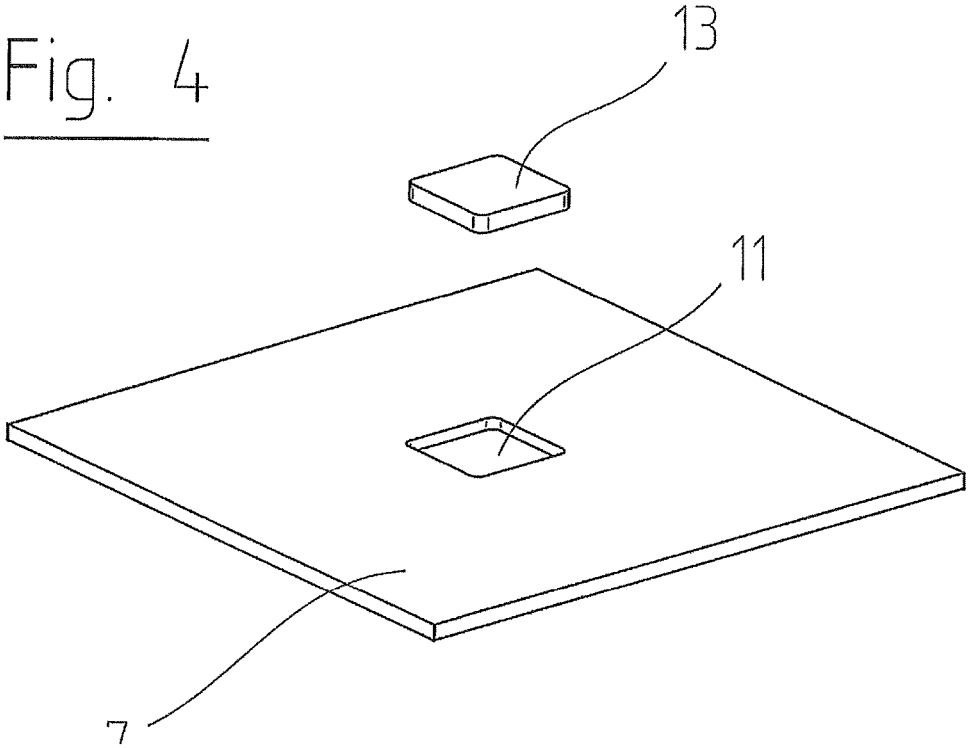
Figure 5:
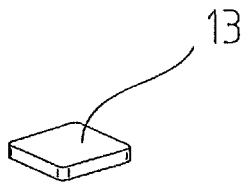
Figure 8:
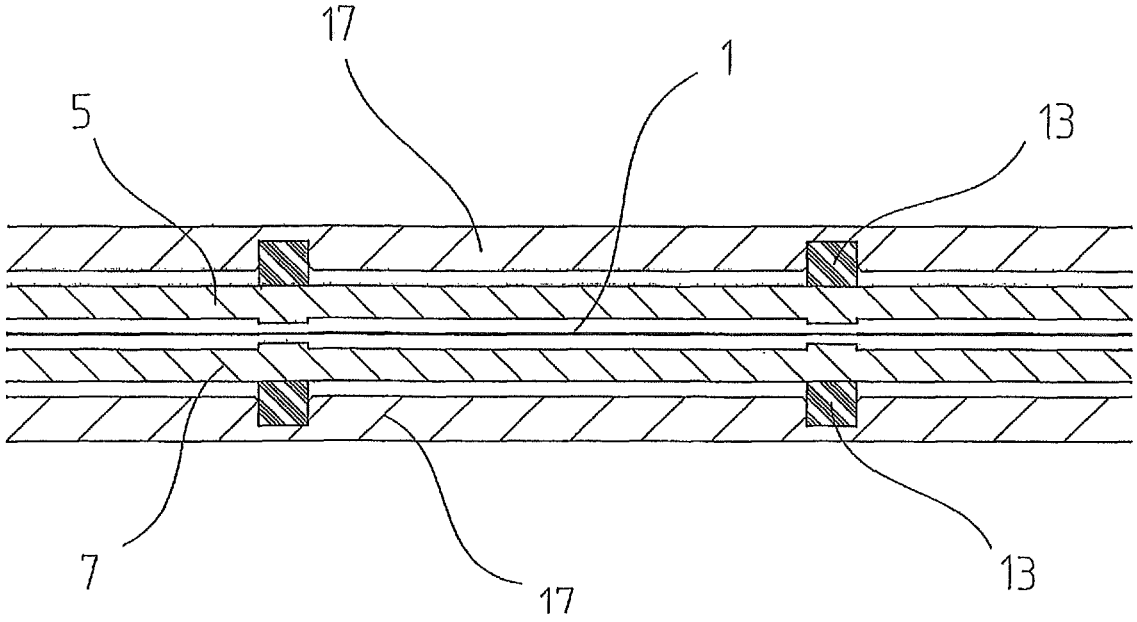

In the schematic diagram in FIG. 1, the exploded-view diagram shows the tool, i.e., the device for removing or undoing selected areas of embossments on embossed films 1. Above the film 1, which can be guided from coil 3 between a female die or die plate 5 and a male die or retaining plate 7, a raised section, here a raised section 9 with smooth surface, is formed on the bottom side of the female die 5. The cross section of the raised section 9 corresponds to the surface area that is to be deformed again, this time so that it becomes completely smooth, to undo the embossment, i.e., the surface of the film 1, on the already embossed film (FIG. 2). A compensating element 13 is inserted in the male die 7 in a recess 11. The compensating element 13 extends past the surface of the male die 7 by a few tenths of a millimeter. The cross section of the compensating element 13 corresponds essentially to at least the cross section of the raised section 9 in the female die 5.

The compensating element 13 can comprise a body made from polyurethane with a Shore hardness of 80 to 90 or a similar elastic plastic.

Optionally, a thin protective sheet 15 that is a few tenths of a millimeter thick lies above the compensating element 13, which can prevent the film 1 guided in the direction of the arrow A between the female die 5 and the male die 7 from friction on the surface of the compensating element 13 or can prevent it from being delayed or damaged by friction.

The female die 5 is mounted in a press on the upper, usually moving part. The male die 7 is mounted fixed on the usually stationary part of the press. A press is not shown in the figures, because its configuration has been known for a long time. The press can be driven hydraulically or mechanically, and the female die 5 can move in quick cycles onto the male die 7, while the film 1 is held in place for a short time for the embossing process.

Below, the procedure for undoing an area of the large-area embossment or multiple areas simultaneously will be described. The film 1 provided with a fine embossment, for example, an orange peel-like embossment, is guided from the coil 3 between the female die 5 and the male die 7 and held in place for a short time so that the female die 5 can be moved onto the male die 7 by the press in one stroke and a force or pressure with the raised sections 9 can be applied to the surface of the film 1. The support of the film 1 is here realized exclusively on the surface of the compensating elements 13 and—if necessary—the protective element 15 arranged between the film 1 and the male die 7, e.g., a very thin deformable sheet over the compensating element 13. Through this elastic underlay, which is arranged opposite the area of the raised section 9, it is possible, surprisingly, to completely undo the embossment present on the film 1 in the area between the raised section 9 and the compensating element 13.

The protective element 15 has no direct influence on the undoing of the embossments on the film 1. It protects the film 1 and its embossments that are also present on the bottom side of the film, so that there can be no friction disrupting the process there during the forward transport of the film 1 in the direction of arrow A. For embossed films 1 with minimum embossment depth and a very smooth and, in any case, easily sliding surface, the protective sheet 15 can also be eliminated.

Figure 6:
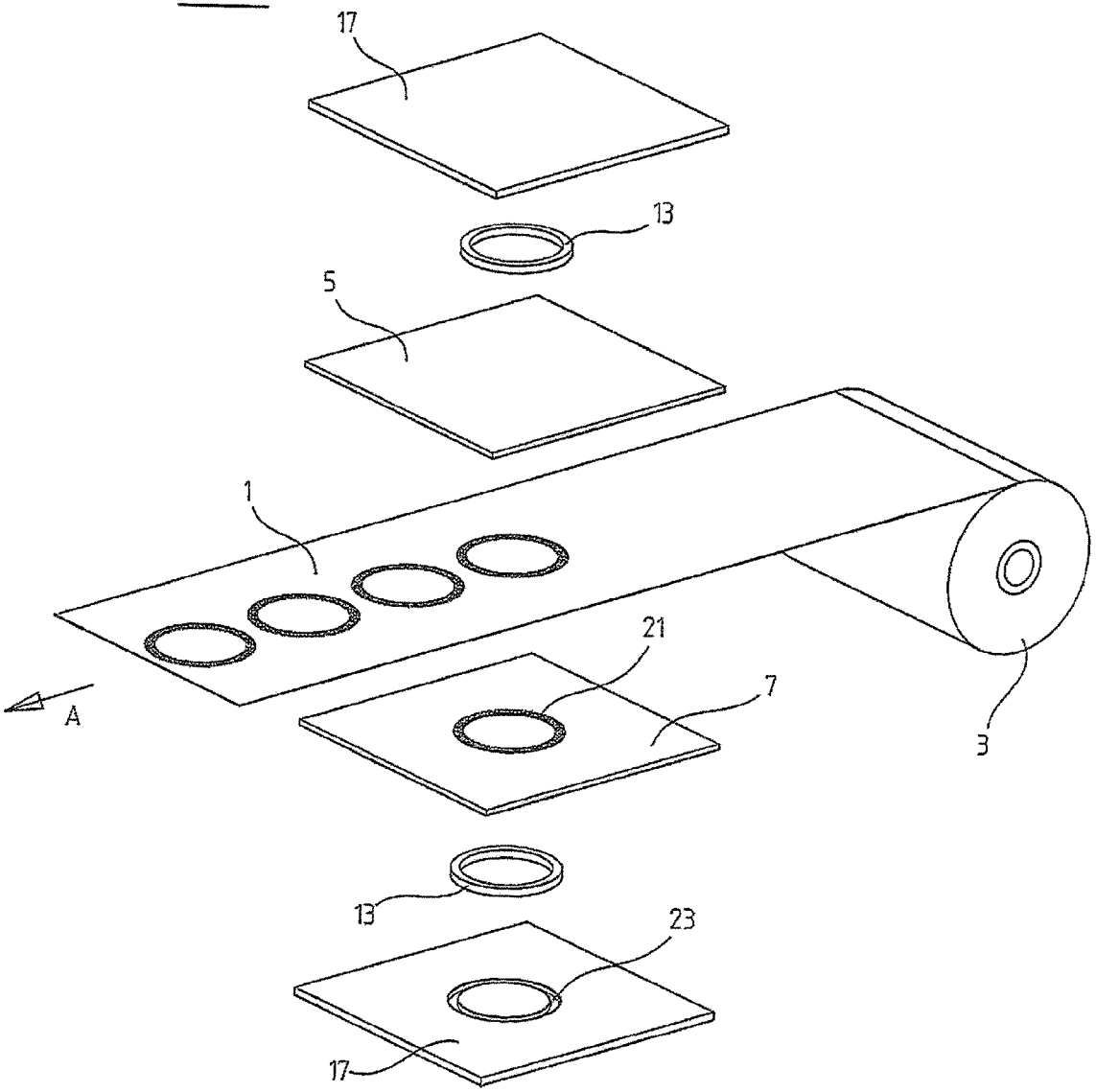
Figure 7:
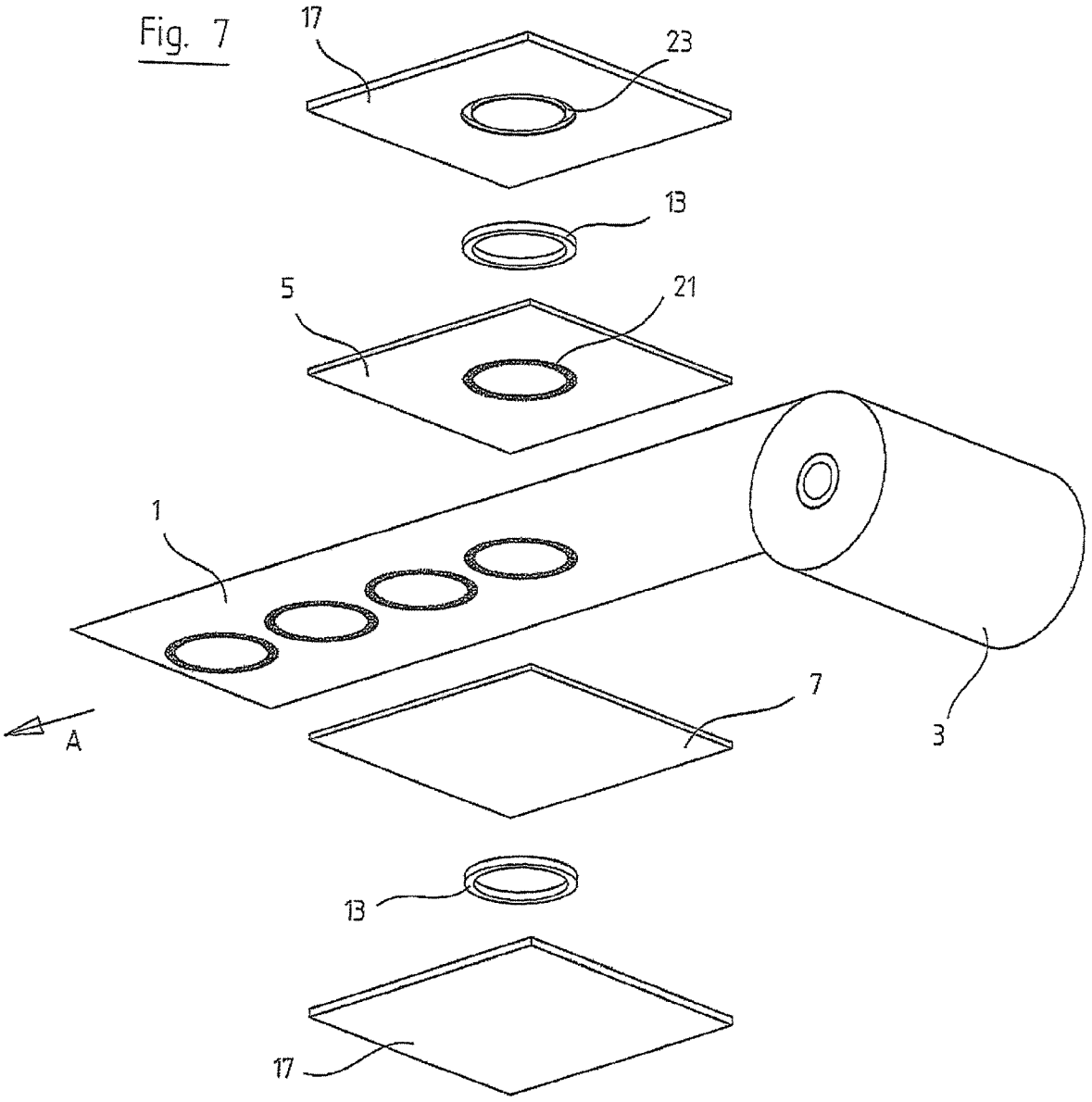

Surprisingly, with this procedure, it is also possible to apply embossments of any shape on smooth, i.e., non-embossed films 1, which comprise only a partial area of the surface of the film or the entire film. In FIGS. 6 and 7, for example, circular ring-shaped embossment areas are created; the surrounding and central areas remain free, i.e., smooth. Such partial embossment areas likewise prevent adhesion of stamped/punched blanks stacked one on top of the other and simultaneously cause the preservation of high-quality painting/graphics applied in multi-color technology on the film. The generation of such partial embossments will be described below with reference to FIGS. 6 and 7.

In the exploded-view diagram according to FIGS. 6 and 7, the individual elements of the embossing tool are shown. Above the film 1, a female die is shown, on whose bottom side the embossing structure is applied by raised sections 21. Above the female die there is a compensating element 13, in the present example, a circular ring element, and above that an upper retaining plate 17. In the retaining plate 17 there is, on its bottom side, a circular ring-shaped recess 23 in which the circular ring-shaped compensating element 13 or a differently shaped compensating element is inserted and wherein the compensating element 13 extends past the recess 23 by a few tenths of a millimeter and contacts the back side of the female die 5 directly behind the raised sections for the embossment.

A mirror symmetric arrangement is provided for the male die 7, in which a circular ring-shaped raised section with the embossment pattern is formed on the surface. Below this is the circular ring-shaped compensating element 13 that is held in a circular ring-shaped recess 23 in the lower retaining plate 17. After joining these individual elements, the compensating element 13 that extends past the lower retaining plate 17 by a few tenths of a millimeter contacts the bottom side of the male die.

The embossment of the non-embossed film 1 is realized in a conventional way with the difference that the female die 5 and the male die 7 are not connected rigidly to the stamping/punching and embossing machine, but instead these two elements (female die and male die) are supported elastically on the back side in the area of the raised sections 21 extending past the embossment.

In order to achieve the local elasticity of the female die 5 and the male die 7, the two elements are made, for example, from brass. The thickness of the brass plate is in the range of 4 millimeters, that is, a thickness that guarantees local elasticity, namely in the area of the raised sections 21.

This elastically supported embossment makes it possible to achieve an optimum embossment result with significantly lower pressing forces by the stamping/punching and embossing device.

The invention claimed is:

1. An embossing tool for deforming smooth and embossed films (1) made from metal or films made from laminates of metal and plastic, the embossing tool being adapted for installation in a stamping/punching and embossing machine, the embossing tool comprising:

a female die (5) with an embossing area, a male die (7), wherein the female die (5) is movably supported for movement relative to the male die (7) by the stamping/punching and embossing machine, in order to emboss a film (1) that is adapted to be led through or inserted between the female die (5) and male die (7), a surface on the male die (7) opposite the embossing area on the female die (5) has an elastically pliant and deformable mounting, a first compensating element (13) arranged on a back side of the female die (5) in the embossing area that includes an embossing structure formed on a bottom side of the female die (5) and a second compensating element (13) arranged on a back side of the male die (7) in the embossing area and an embossing structure formed on a top side of the male die (7), and wherein the first and second compensating elements (13) are each arranged on a respective retaining plate (17) or in a recess or a notch (19) on the retaining plate (17) or in the back sides of at least one of the female die (5) or the male die (7).

2. The embossing tool according to claim 1, wherein the first and second compensating elements (13) are arranged opposite to and coaxial to each other.

3. The embossing tool according to claim 1, wherein the compensating elements (13) are constructed from plastic.

4. The embossing tool according to claim 3, wherein the plastic has a Shore hardness of 80-90.

5. The embossing tool according to claim 1, wherein the compensating elements (13) are made from polyurethane.

6. The embossing tool according to claim 1, further comprising a deformable protective element (15) that is a few tenths of a millimeter thick placed at least over one of the first or second compensating elements (13) for preventing friction or adhesion of the film (1) on the at least one of the first or second compensating elements (13).

* * * * *